US005288920A

United States Patent [19]

Chan et al.

[11] Patent Number: 5,288,920

[45] Date of Patent: Feb. 22, 1994

[54] FCC RISER DISCHARGE SEPARATION AND QUENCH APPARATUS

[75] Inventors: Henry C. Chan, Bellaire; Ting Y. Chan, Houston, both of Tex.

[73] Assignee: Texaco Inc., White Plains, N.Y.

[21] Appl. No.: 910,798

[22] Filed: Jul. 9, 1992

Related U.S. Application Data

[62] Division of Ser. No. 620,180, Nov. 30, 1990, Pat. No. 5,217,602.

[51] Int. Cl.[5] ..... B27B 15/16; B01J 8/18

[52] U.S. Cl. ..... 422/146; 55/459.1; 208/48 Q; 239/596; 422/145; 422/147

[58] Field of Search ..... 422/147, 145, 146, 214; 208/48 Q, 150; 239/596; 55/459.1

[56] References Cited

U.S. PATENT DOCUMENTS

| | | | |
|---|---|---|---|
| 1,151,258 | 8/1915 | Fischer | 239/596 |
| 2,793,173 | 5/1957 | Fritz | 208/48 Q |
| 2,906,695 | 9/1959 | Boston | 208/48 Q |
| 2,943,994 | 7/1960 | McCain, Jr. | 208/48 Q |
| 3,015,619 | 1/1962 | Wimmer et al. | 208/48 Q |
| 3,133,014 | 5/1964 | Cross, Jr. | 208/48 Q |
| 3,174,924 | 3/1965 | Clark et al. | 208/48 Q |
| 3,322,647 | 5/1967 | Calaway | 208/48 Q |
| 3,663,645 | 5/1972 | Dorn et al. | 208/48 Q X |
| 4,313,910 | 2/1982 | Dries et al. | 422/147 |
| 4,664,888 | 5/1987 | Castagnos, Jr. | 422/147 |
| 4,764,268 | 8/1988 | Lane | 208/48 Q X |
| 5,087,427 | 2/1992 | Quinn et al. | 208/48 Q |
| 5,089,235 | 2/1992 | Schwartz et al. | 422/146 X |

*Primary Examiner*—Robert J. Warden
*Assistant Examiner*—Amalia Santiago
*Attorney, Agent, or Firm*—James L. Bailey; Richard A. Morgan

[57] ABSTRACT

In a fluid catalytic cracking (FCC) process riser reactor effluent is rapidly separated into spent catalyst and hydrocarbon product. The separated hydrocarbon product is immediately quenched to an unreactive temperature in the absence of quenching spent catalyst. An increase in debutanized naphtha yield is achieved. By avoiding catalyst quenching, heat duty is saved in the catalyst regenerator.

10 Claims, 2 Drawing Sheets

Fig. 2
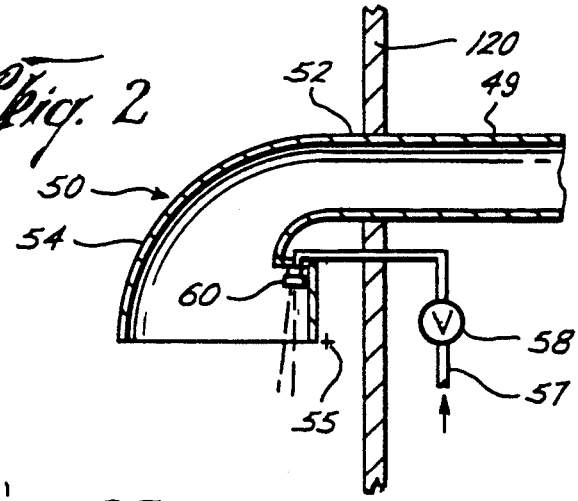
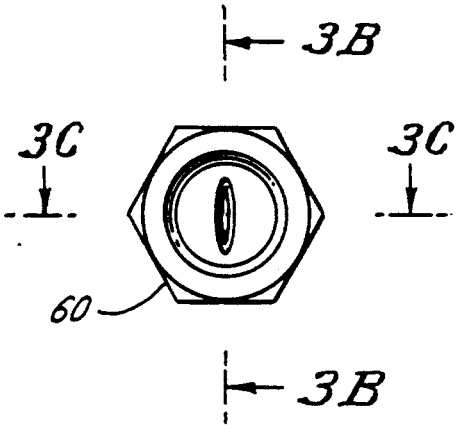
Fig. 3A
Fig. 3B
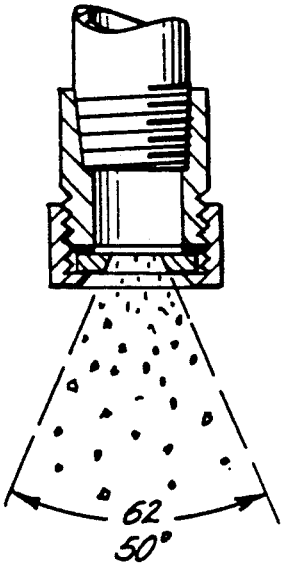
Fig. 3C
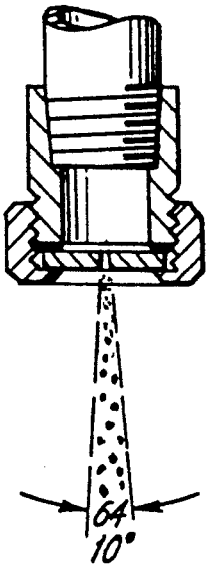

FCC RISER DISCHARGE SEPARATION AND QUENCH APPARATUS

CROSS-REFERENCE TO RELATED APPLICATION

This application is a divisional application of Ser. No. 07/620,180, filed Nov. 30, 1990 now U.S. Pat. No. 5,217,602 issued June 8, 1993 for FCC Riser Discharge Separation And Quench.

BACKGROUND OF THE INVENTION

1. Field of the Invention

The invention is a process and apparatus for the separation of a catalyst phase from a cracked hydrocarbon phase in the fluid catalyst cracking (FCC) of hydrocarbon. More particularly, the invention is a process and apparatus to reduce post riser cracking of cracked hydrocarbon discharged from a riser reactor. The invention is also a process and apparatus which heat integrates the riser reactor, and the catalyst regenerator, thereby reducing the heat duty in a fluid catalyze cracking (FCC) process.

2. Other Related Methods and Apparatus in the Field

Fluid catalytic cracking (FCC) processes are known in the art. State of the art commercial catalytic cracking catalysts for these processes are highly active and selective for converting hydrocarbon charge stocks to liquid fuel products. With such active catalysts it is preferable to conduct catalytic cracking reactions in a dilute phase transport type reaction system with a relatively short period of contact between the catalyst and the hydrocarbon feedstock, e.g. 0.2 to 10 seconds.

The control of short contact times, optimum for state of the art catalysts in dense phase fluidized bed reactors is not feasible. Consequently, catalytic cracking systems have been developed in which the primary cracking reaction is carried out in a transfer line reactor or riser reactor. In such systems, the catalyst is dispersed in the hydrocarbon feedstock and passed through an elongated reaction zone at relatively high velocity. In these transfer line reactor systems, feedstock acts as a carrier for the catalyst. In a typical upflow riser reactor, the hydrocarbon vapors move with sufficient velocity as to maintain the catalyst particles in suspension with a minimum of back mixing of the catalyst particles with the gaseous carrier. Thus development of improved fluid catalytic cracking catalysts has led to the development and utilization of reactors in which the reaction is carried out with the solid catalysts particles in a relatively dilute phase with the catalyst dispersed or suspended in hydrocarbon vapors undergoing reaction, e.g., cracking.

The cracking reactions are conveniently carried out in high velocity transport line reactors wherein the catalysts is moved from one vessel to another by the hydrocarbon vapors. Such reactors have become known in the art as risers or riser reactors. The catalyst and hydrocarbon mixture passes from the transfer line reactor into a first separation zone in which hydrocarbon vapors are separated from the catalyst. The catalyst particles are then passed into a second separation zone, usually a dense fluidized bed stripping zone wherein further separation of hydrocarbons from the catalyst takes place by stripping the catalyst with steam. After separation of hydrocarbons from the catalyst, the catalyst is introduced into a regeneration zone where carbonaceous residues are removed by burning with air or other oxygen-containing gas. After regeneration, hot catalyst from the regeneration zone is reintroduced into the transfer line reactor with fresh hydrocarbon feed.

As stated, state of the art catalytic cracking catalysts are highly active. With the introduction of these highly active catalysts the first separation zone has become a limiting unit operation. When catalyst is not rapidly separated from vapor and the vapor quenched once the desired reactions have taken place, the cracking reactions will continue with the production of less desirable products. Rough-cut cyclones have been used as a first separation stage between catalyst and vapor, followed by finer cut cyclones to remove fines from the vapor.

U.S. Pat. No. 4,664,888 to L. F. Castagnos, Jr. teaches a rough cut catalyst-vapor separator in a fluid catalytic cracking process. In the separator a separator surface causes the oil-catalyst mixture to undergo a 180° turn. Catalyst moves toward the separator surface to form a catalytic phase. Vapor is squeezed away from the wall forming a vapor phase. A shave edge maintains the separation.

U.S. Pat. Nos. 4,764,268 and 4,624,771 both to P. A. Lane teach a fluid catalytic cracking process. A quench fluid is passed into a downstream portion of the riser reactor in the last 10 vol% to prevent overcracking of hydrocarbon products. The quench fluid is inert to cracking, e.g. water, steam or a selected hydrocarbon. The catalyst and vapor are separated after quenching. An advantageous yield of product of a desirable octane number is achieved.

Perry's Chemical Engineers'Handbook, 4th Ed., p. 18-64 teaches fan nozzles. The nozzles form a flat fan-shaped fluid sheet. The included angle of the fan is from 10 deg. to 130 deg. in standard nozzles and capacities range from 0.1 to 20 gal./minute.

BRIEF DESCRIPTION OF THE INVENTION

The invention is an improvement in a fluid catalytic cracking (FCC) process. In an FCC process, a hydrocarbon feedstock in suspension with a fluidized catalyst is cracked at catalytic reaction temperature to form a mixture of cracked hydrocarbon and spent catalyst. The mixture is separated into separated cracked hydrocarbon and spent catalyst phases.

The improvement comprises quenching the separated cracked hydrocarbon to an unreactive temperature substantially simultaneously with separating the two phases. The quenching of the separated cracked hydrocarbon is carried out in the absence of quenching spent catalyst. The absence of quenching spent catalyst results in a reduction in heat duty in the catalyst regenerator where carbonaceous matter is burned from the catalyst.

BRIEF DESCRIPTION OF THE DRAWINGS

FIG. 2 is a schematic side view of a separator/quench apparatus.

FIG. 3A is an end elevation of a fan nozzle.

FIG. 3B is a longitudinal section through a fan nozzle showing a first spray configuration.

FIG. 3C is a longitudinal section through a fan nozzle showing a second spray configuration.

DETAILED DESCRIPTION OF THE INVENTION

Figure 1:
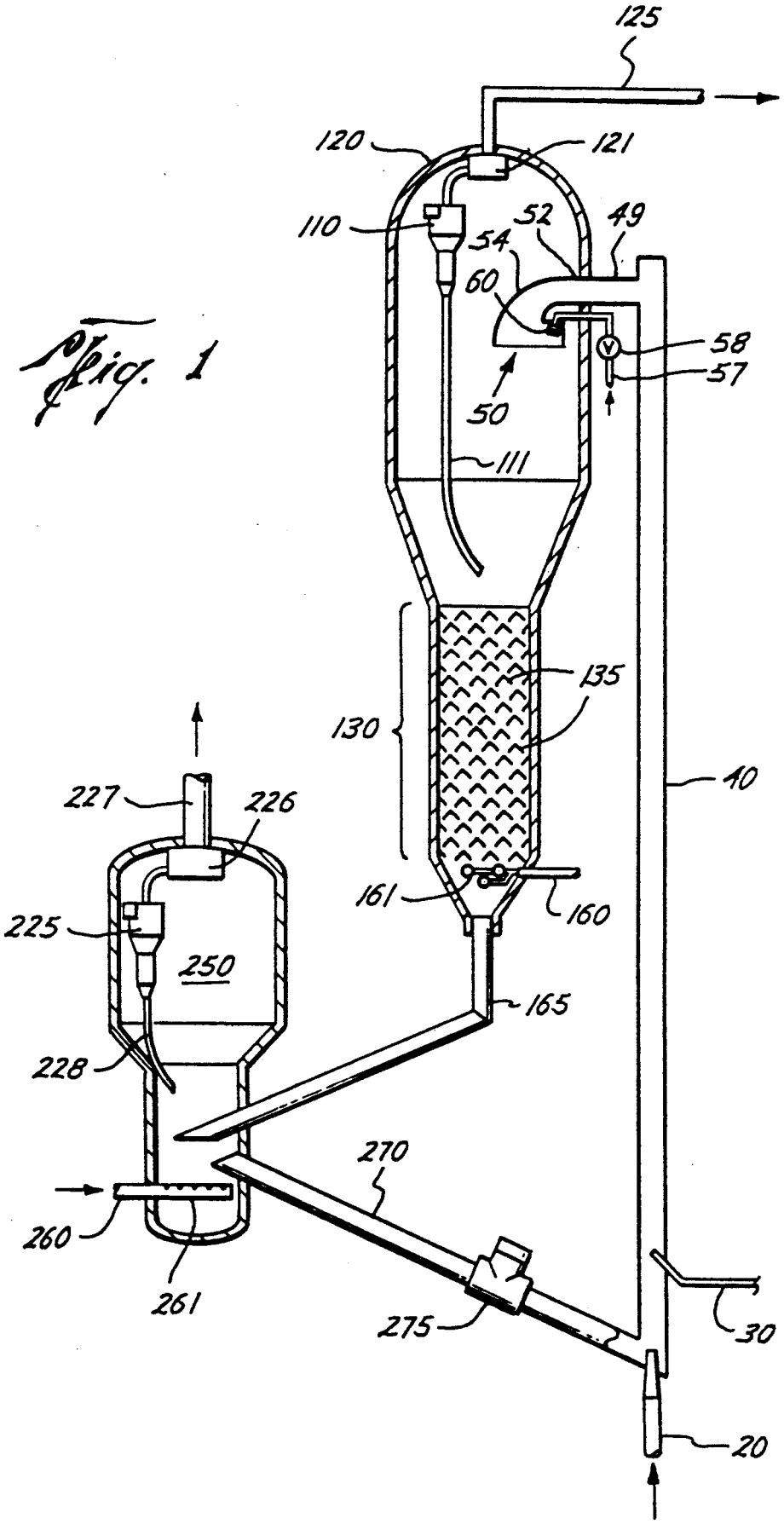
FIG. 1 is a diagrammatic arrangement of a fluid catalytic cracking process comprising a riser reactor, catalyst separator, reactor vessel and catalyst regenerator.

Reference is made to FIG. 1 which is representative of an apparatus for contacting a hydrocarbon feedstock with finely divided fluidized catalyst in riser reactor 40 at catalytic cracking conditions. A clean, freshly regenerated catalyst is delivered from regenerated catalyst standpipe 270 into the lower portion of riser reactor 40. The regenerated catalyst has a carbon content less than about 0.1 wt% and an ASTM microactivity of 60 to 70. As the catalyst enter the riser, its temperature decreases from 1300° F. to 1400° F. by the addition of a fluidization medium delivered by line 20. The fluidization medium may be steam, nitrogen or low molecular weight hydrocarbons such as methane, ethane, ethylene or fuel gas. The amount of fluidization medium must be sufficient to fluidize the fluid zeolite catalyst in the base of riser 40 above the minimum fluidization velocity to move the catalyst toward the injection point of the hydrocarbon oil. A liquid feedstock, such as vacuum gas oil, atmospheric residuum, deasphalted oil or combinations thereof, having a boiling range of about 400° F. to 1000° F., is heated and delivered to riser reactor 40 through conduit 30. The feedstock enters the riser by way of an injection nozzle (not shown) which may be a single nozzle or an arrangement of more than one nozzle which mixes oil and catalyst quickly and completely after injection. The amount of catalyst circulated must be enough to completely vaporize the oil and be sufficient to crack the feedstock to a slate of products which when corrected to room temperature include gases, low boiling liquids and fuel boiling range liquids such as gasoline and light cycle gas oil. The mixture of products and unconverted gas oil vapor have sufficient velocity to transport the fluid catalyst upwardly through the riser 40.

The riser conversion zone comprises the internal volume of the riser from the lower injection point to separator/quencher 50 including transitional conduit 49 and discharge conduit 52. Separator/quencher 50 is closed coupled with riser 40 so that all of the reaction mixture from the riser reactor flows into it. Separated hydrocarbon vapor passes into reactor vessel 120. From there, hydrocarbon vapor passes into secondary cyclone 110, plenum 121 and is transported through conduit 125 to fractionation and purification means (not shown). Separated catalyst from separator/quencher 50 and catalyst from secondary cyclone 110 falls to a lower portion of the reactor vessel 120 through dipleg 111. The dipleg is sealed by means such as J-valves, trickle valves, flapper valves (not shown).

The catalyst flows into the stripping zone 130 containing baffles 135 or other means to contact the catalyst and stripping gas. The stripping gas may be nitrogen, steam or other suitable material delivered by conduit 160 to distributor 161. Distributor 161 uniformly disperses the stripping gas into the stripping zone 130 and removes volatile and volatizable hydrocarbons. A hotter catalyst temperature in stripping zone 30 increases the amount of hydrocarbon volatized and stripped from the catalyst. The hydrocarbons stripped from the catalyst and stripping gas flow out of reactor vessel 120 with the product vapors through secondary cyclone separator 110, plenum 121 and conduit 125.

The stripped catalyst leaves stripping zone 130 and is delivered to the regenerator 250 by way of spent catalyst standpipe 165. The regenerator 250 contains a lower dense phase bed of catalyst and an upper dilute phase of catalyst. Catalyst is uniformly distributed across the upper surface of the dense phase bed. Most of the coke is removed in the dense phase bed. A combustion medium of air or oxygen and nitrogen is delivered by conduit 260 to a distribution device 261 to mix combustion medium and coked catalyst. Coke is burned from the catalyst to give a flue gas containing amounts of $CO_2$, $SO_2$, and $NO_x$. The combustion of the coke to $CO_2$ is preferably carried out at a regenerator temperature above about 1200° F. and below about 1400° F. in the presence of a combustion promoter such as platinum residing on the catalyst so that 0.1 wt% or less residual carbon is left on the catalyst. The flue gas passes through the regenerator dilute phase, cyclone 225, plenum 226 and flue gas line 227 for further processing. As the flue gas passes through the cyclone, catalyst is separated and returned to the dense bed by way of dipleg 228. The regenerated catalyst flows from the dense bed to standpipe 270. Slide valve 275 regulates the flow of regenerated catalyst from standpipe 270 to riser 40.

Reference is made to FIG. 2, a schematic representation of separator/quencher 50.

A catalyst and cracked hydrocarbon mixture flows through discharge conduit 50 which directs the mixture toward centrifugal separator wall 54. Centrifugal separator wall 54 is geometrically described by one-quarter of a circle in the vertical plane parallel to the surface of the paper. The radius of the circle is substantially larger than the radius of discharge conduit 52. The center of the circle is point 55. In this representation, the radius is approximately five times the radius of discharge conduit 52. This relatively large axis of rotation causes a deflection of the mixture from flow in the horizontal direction to downward flow. This change in direction also causes the centrifugal disengagement or separation of the steam into a downwardly flowing predominantly catalyst phase which is in contact with wall 54 and a predominantly cracked vapor phase, spaced from the wall 54.

Quench fluid is introduced via quench line 57 and valve 58 into separator/quencher 50. The quench fluid is discharged into the predominately cracked vapor phase by means of nozzle 60.

FIGS. 3A, 3B and 3C are three views of nozzle 60 and the spray pattern of quench fluid it produces in separator/quencher 50. The spray pattern is critical to the invention. Substantially all of the quench fluid spray must remain in the cracked vapor phase and not cross into the catalyst phase before the quench fluid is vaporized. Nozzles which produce such a spray pattern are commercially available. Fish tail nozzles and fan nozzles produce a relatively flat sheet or flat ellipse of spray which is well defined. The spray is so well defined that the nozzle is selected for the exact spray angle in both dimensions.

A fan nozzle produces a flat sheet of spray in an elliptical spray pattern. The sheet becomes thinner with distance from the nozzle. Surface tension causes the thin sheets to break up into droplets at a distance from the nozzle.

Fan nozzles which produce spray angles of 10° to 110° are commercially available. It is characteristic of fan nozzles that sheets of very uniform thickness are formed at included angles of 50° to 10° . At larger included angles two separate streams called horns are produced with liquid sheets connecting the horns. These horns have much less surface area than the sheets and may remain in the liquid state long enough to contact hot catalyst, which is undesirable because of quenching.

The nozzles which produce more uniform sheets of quench fluid also produce the narrow pattern required to avoid impingement of the catalyst phase with quench fluid. The fan nozzle is therefore oriented so that the long axis of the ellipse is perpendicular to the cracked hydrocarbon-catalyst interface. The short axis is perpendicular with the interface. The long axis has an included angle 62 of 50° in FIG. 3B. The short axis has an included angle 64 of 10° in FIG. 3C.

When hydrocarbon fractions are catalytically cracked, the most desirable products are debutanized naphtha with an end point about 430° F. (gasoline) and light cycle gas oil boiling from 430° F. to about 670° F. The highest yield of these fractions is achieved by cracking at fluid catalytic cracking conditions at a temperature in the range 900° F. to 1100° F., preferably 950° F. to 1000° F. for 0.5 to 1.5 seconds and then terminating the cracking reaction at the riser outlet. The cracking reaction is terminated at temperatures of about 940° F. and less defined herein as an unreactive temperature. When the cracking reaction continues for even short periods of time past the optimum, the yield of the most desirable products decreases. The decrease in desirable products is attributed to an increase in the dry (hydrocarbon) gas make.

Attempts have been made to improve the separation of catalyst and hydrocarbon product in order to stop the catalytic cracking reaction. The yield of desirable products has been increased, but these are increments of yield to be gained by terminating thermal cracking reactions as well as catalytic cracking reactions.

Methods of quenching riser reactor effluent have included quenching the entire hydrocarbon-catalyst mixture. The portion of the quench which is used on the catalyst must be made up in the regenerator. Therefore the heat to quench the catalyst is lost to the catalyst regeneration stage and the same amount of heat must be added to the catalyst regenerator. To make up this heat, torch oil is added directly to the catalyst regenerator to raise the regenerator to the desired regeneration temperature. This torch oil can be reduced or even eliminated if the quenching of catalyst is avoided.

This invention is shown by way of example.

EXAMPLE

A computer simulation of a commercial fluid catalytic cracking unit such as that shown in FIG. 1 was made based on correlations of operating data taken from a commercial process. Two simulation runs are reported in Table 1. Run 1 gives the product yields and conversion from the rapid separation of hydrocarbon product from catalyst in the absence of quench. Run 2 gives the product yields and conversion when the hydrocarbon product was rapidly separated from catalyst and then quenched. Quenching in Run 2 yielded the same amount of total gas to the compressor as Run 1 but less total dry gas. This allowed for an increased feed rate in Run 2 at constant gas compressor loading (total gas to compressor).

The data shows that the conversion of feedstock decreased while the yield of debutanized naphtha (DB naph) increased with quenching. This is attributed to the reduction in overcracking.

TABLE 1

| | Run 1 (Comparative) | Run 2 |
|---|---|---|
| Fresh Feed | | |
| API Gravity | 19° | 19° |
| Sulfur | 1.71 Wt % | 1.71 Wt % |
| Carbon Residue | 0.25 Wt % | 0.25 Wt % |
| Operating Conditions | | |
| Fresh Feed Rate | 29400 B/D | 32600 B/D |
| Throughput Ratio | 1.07 | 1.07 |
| Feed Preheat | 482° F. | 482° F. |
| Riser Outlet | 984° F. | 984° F. |
| Amount of Quench | 0° F. | 50° F. |
| Regenerator Bed | 1351° F. | 1334° F. |
| Conversion 430° F. | 73.55 Vol % | 72.34 Vol % |

| | Run 1 (Comparative) | | Run 2 | |
|---|---|---|---|---|
| | Vol % | Wt % | Vol % | Wt % |
| Yields: Perfect Fractionation | | | | |
| $H_2S$ | | 0.80 | | 0.81 |
| $H_2$ | | 0.09 | | 0.09 |
| C1 | | 1.69 | | 1.34 |
| C2 | | 1.55 | | 1.24 |
| C2 Olefin | | 1.20 | | 0.97 |
| Total Dry Gas | | 4.53 | | 3.64 |
| $H_2$—$C_2$ Olefin | | | | |
| C3 | 2.49 | 1.34 | 2.38 | 1.28 |
| C3 Olefin | 7.81 | 4.32 | 7.50 | 4.15 |
| iC4 | 2.97 | 1.78 | 2.76 | 1.65 |
| nC4 | 1.56 | 0.97 | 1.50 | 0.93 |
| C4 Olefin | 7.49 | 4.83 | 7.20 | 4.64 |
| Total C3–C4 | 22.32 | 13.24 | 21.34 | 12.65 |
| Total C3–C4 Olefins | 15.30 | 9.15 | 14.70 | 8.79 |
| Total Gas to Compressor | | | | |
| $H_2S$—C4 Olefin Lb-Mol/hr | | 2,161 | | 2,164 |
| Lt. Naph | 37.32 | 27.20 | 37.77 | 27.53 |
| Hvy. Naph | 22.35 | 19.77 | 22.61 | 20.00 |
| DB Naph | 59.67 | 46.97 | 60.38 | 47.53 |
| LCGO | 17.87 | 18.54 | 19.57 | 20.26 |
| HCGO | 8.58 | 10.53 | 8.09 | 9.84 |
| Coke | | 5.39 | | 5.27 |
| DB Naph RON | | 93.7 | | 93.4 |
| Octane-bbl/hr | | 68,491 | | 76,603 |

Carbon Residue — Conradson Carbon Residue ASTM D-4530-85
DB Naph — debutanized naphtha C5-430° F.
Lt. Naph — light naphtha C5-250° F.
Hvy. Naph — heavy naphtha 250° F.–430° F.
LCGO — light cycle gas oil 430° F.–650° F.
HCGO — heavy cycle gas oil 650° F.–1050° F.
RON — research octane number
B/D — barrels/day While particular embodiments of the invention have been described, it will be understood that the invention is not limited thereto since modifications may be made and it is therefore contemplated to cover by the appended claims any such modifications as full within the spirit and scope of the claims.

What is claimed is:

1. An apparatus for fluid catalytic cracking a hydrocarbon feedstock comprising:

a containment vessel, a riser reactor comprising an upstream end and a downstream end, a separator within the containment vessel for separating a mixture of spent catalyst and cracked product vapor, and a conduit providing fluid communication for said mixture between the downstream of said riser reactor end and the separator, the separator comprising:

a centrifugal separation surface, curved to cause separation of the mixture into a spent catalyst phase in contact with the surface and a cracked product vapor phase spaced from the surface, a tubular means for transporting quench fluid to a nozzle disposed inside and opposite the centrifugal separation surface having a spray pattern providing discharge of essentially all of the quench fluid into the cracked product vapor phase and out of contact with said catalyst phase.

2. The apparatus of claim 1 wherein in the nozzle the spray pattern is an ellipse having a minor axis of 10° to 50°.

3. The apparatus of claim 1 wherein the nozzle of the spray pattern is an ellipse having a minor axis of about 10°.

4. The apparatus of claim 1 wherein the nozzle of the spray pattern is a flat sheet.

5. An apparatus for fluid catalytic cracking a hydrocarbon feedstock comprising:

a containment vessel, a riser reactor comprising an upstream end and a downstream end, a separator within the containment vessel for separating a mixture of spent catalyst and cracked product vapor, and a conduit providing fluid communication for said mixture between the downstream end of said riser reactor and the separator, the separator comprising:

a centrifugal separation surface, having circular cross-sectional curvature to cause separation of the mixture into a spent catalyst phase in contact with the surface and a cracked product vapor phase spaced from the surface, a tubular means for transporting quench fluid to a nozzle disposed inside and opposite the centrifugal separation surface having a spray pattern providing discharge of essentially all of the quench fluid into the cracked product vapor phase and out of contact with said catalyst phase.

6. The apparatus of claim 5 wherein in the nozzle the spray pattern is an ellipse having a major axis parallel to the phase interface and a minor axis of 10° to 50°.

7. The apparatus of claim 5 wherein in the nozzle the spray pattern is an ellipse having a major axis parallel to the phase interface and a minor axis of about 10°.

8. The apparatus of claim 5 wherein in the nozzle the spray pattern is a flat sheet.

9. The apparatus of claim 5 wherein in the centrifugal separation surface the cross-sectional curvature is one-quarter circle in a vertical plane.

10. An apparatus for fluid catalytic cracking a hydrocarbon feedstock comprising:

a containment vessel, a vertically elongated riser reactor having an upstream end and a downstream end of said riser reactor, the downstream end terminating within the containment vessel, and a reaction zone contained within the riser reactor;

means for introducing a suspension of hydrocarbon feedstock and catalyst into the upstream end of the riser reactor and discharging a mixture of spent catalyst and cracked hydrocarbon from the downstream end of the riser reactor;

a first conduit attached to and connecting the downstream end of the riser reactor to a separator, the separator comprising:

a separation surface sufficiently curved to cause centrifugal separation, said surface positioned to cause said mixture to flow there along thereby centrifugally separating said mixture into a predominantly spent catalytic phase in contact with the separator surface and a predominately cracked hydrocarbon phase spaced from said surface;

a tubular means for transporting quench fluid to a nozzle disposed inside and opposite the separation surface having a discharge pattern providing discharge of essentially all of said quench fluid into said cracked hydrocarbon phase and out of contact with said catalyst phase.

* * * * *

UNITED STATES PATENT AND TRADEMARK OFFICE

CERTIFICATE OF CORRECTION

PATENT NO. : 5,288,920

DATED : February 22, 1994

INVENTOR(S) : Henry Choisun Chan, et al.

It is certified that error appears in the above-indentified patent and that said Letters Patent is hereby corrected as shown below:

In column 6, line 67, after "downstream" insert --end--.

In column 6, line 68, delete "end".

Signed and Sealed this

Twenty-eighth Day of June, 1994

*Attest:*

BRUCE LEHMAN

*Attesting Officer*

*Commissioner of Patents and Trademarks*